US006047837A

United States Patent [19]

Kessens

[11] Patent Number: 6,047,837

[45] Date of Patent: Apr. 11, 2000

[54] BUCKET MOUNTING MECHANISM

[76] Inventor: Harry J. Kessens, 5009 14th Ave. South, Minneapolis, Minn. 55417

[21] Appl. No.: 09/184,140

[22] Filed: Oct. 13, 1998

Related U.S. Application Data

[63] Continuation-in-part of application No. 08/724,262, Sep. 19, 1996, abandoned.

[51] Int. Cl.[7] ..... A47F 7/28

[52] U.S. Cl. ..... 211/85.21; 248/311.2; 211/181.1

[58] Field of Search ..... 211/75, 85.21, 211/89.01, 73, 71.01, 74, 181.1, 85.18, 85.19, 85.22; 248/302, 311.2, 314, 300

[56] References Cited

U.S. PATENT DOCUMENTS

| | | | |
|---|---|---|---|
| D. 149,261 | 4/1948 | DeMott . | |
| D. 300,890 | 5/1989 | Roland . | |
| D. 300,891 | 5/1989 | Roland . | |
| 428,622 | 5/1890 | Moody . | |
| 2,071,944 | 2/1937 | Hoffman . | |
| 2,102,083 | 12/1937 | MacDonald . | |
| 2,320,828 | 6/1943 | Murphy . | |
| 2,614,700 | 10/1952 | Kjeldsen | 211/75 |
| 3,033,375 | 5/1962 | Cole . | |
| 3,069,019 | 12/1962 | Schuster . | |
| 3,964,708 | 6/1976 | Reeves | 248/314 |
| 4,064,992 | 12/1977 | Ralston et al. | 211/75 |
| 4,093,171 | 6/1978 | Mengo, Sr. | 248/314 |
| 4,378,889 | 4/1983 | Lebowitz . | |
| 4,508,303 | 4/1985 | Beckerer, Jr. . | |
| 4,679,695 | 7/1987 | Leff | 211/74 |
| 4,682,699 | 7/1987 | Ertley . | |
| 5,000,124 | 3/1991 | Bergen | 211/75 |
| 5,190,257 | 3/1993 | Gradei et al. | 248/314 |
| 5,397,006 | 3/1995 | Terrell | 211/74 |
| 5,400,990 | 3/1995 | Krankel | 211/74 |
| 5,711,502 | 1/1998 | Emalfarb et al. | 248/314 |

*Primary Examiner*—Daniel P. Stodola
*Assistant Examiner*—Jennifer E. Novosad
*Attorney, Agent, or Firm*—Welsh & Katz, Ltd.

[57] ABSTRACT

A bucket mounting mechanism for mounting a bucket with respect to a mounting surface includes a bucket receiving portion and a mounting portion. The bucket receiving portion has a substantially cylindrical shape. The mounting portion is capable of retaining the bucket receiving portion at an angle with respect to the mounting surface.

12 Claims, 4 Drawing Sheets

BUCKET MOUNTING MECHANISM

This application is a continuation-in-part of U.S. application Ser. No. 08/724,262 filed Sep. 19, 1996, now abandoned.

BACKGROUND OF THE INVENTION

The present invention relates generally to a mechanism for mounting buckets with respect to a surface. More particularly, the present invention relates to a bucket mounting mechanism for removably mounting cylindrically-shaped buckets with respect to a vertically-disposed wall.

In recent years, it has become common to use buckets for storage because buckets provide a discrete location for storing various objects while allowing the objects to be readily transported, such as when the objects are moved to a location where the objects will be used. The storage buckets typically have capacities of between 1 and 5 gallons and contain a handle that allow the buckets to be readily carried.

One industry where 5 gallon buckets are predominately used is painting contractors. The painting contractors typically acquire large numbers of buckets because paint is commonly packaged in 5 gallon buckets. Rather than purchasing other storage containers for holding painting tools and supplies, painting contractors typically use the 5 gallon buckets for storing the tools and supplies.

The 5 gallon buckets typically have a diameter of approximately 12 inches and a height of approximately 18 inches. The dimensions make the 5 gallon buckets sufficiently large to hold a relatively large amount of tools and supplies. However, the size of 5 gallon buckets limits the amount of tools and supplies that can be placed in the bucket so that the bucket can be carried when filled with tools and supplies.

The popularity of using 5 gallon buckets for storing tools and supplies is further evidenced by the introduction of products that are designed to be used with 5 gallon buckets to increase the utility of 5 gallon buckets. These products include tool holders that hang over the outside of the buckets and seat cushions that fit over the top of the buckets.

In spite of the foregoing uses for buckets, the potential utility of buckets in general, and 5 gallon buckets in particular, is limited by the fact that there has been no apparatus for efficiently storing buckets in an organized configuration. Buckets are typically placed in a vertically oriented manner to maximize the amount of material that may be stored in the buckets. A drawback of this orientation is that it precludes stacking buckets on top of each other because the tools and supplies in the lower level buckets would be inaccessible.

Alternatively, buckets are placed in a horizontally oriented manner, which allows tools and supplies stored in all of the buckets to be easily accessed. A drawback of this orientation is that horizontally oriented buckets allow tools and supplies placed in the buckets to fall out of the buckets. This orientation also precludes removing one of the lower level buckets without disrupting the orientation of higher level buckets.

SUMMARY OF THE INVENTION

The present invention is a bucket mounting mechanism for removably mounting a bucket with respect to a mounting surface. The bucket mounting mechanism includes a bucket receiving portion and a mounting portion. The bucket receiving portion has a substantially cylindrical inner surface and is adapted to receive the bucket. The mounting portion is capable of retaining the bucket receiving portion at an angle with respect to the mounting surface.

DETAILED DESCRIPTION OF THE PREFERRED EMBODIMENTS

Figure 1:
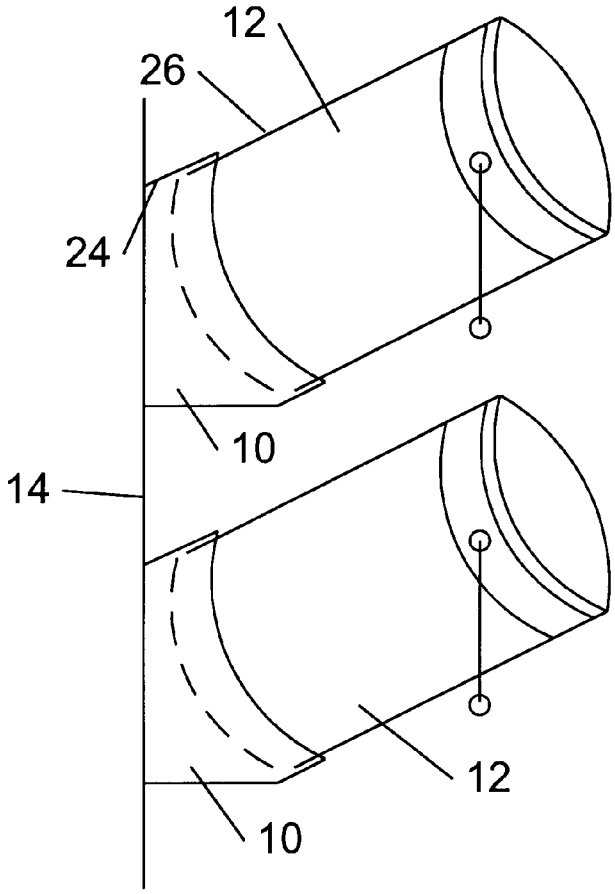
FIG. 1 is side elevational view illustrating the use of bucket mounting mechanisms for removably mounting buckets.

The bucket mounting mechanism according to the present invention is illustrated at 10 in FIG. 1. The bucket mounting mechanism 10 allows a bucket 12 to be removably mounted with respect to a mounting surface 14. More preferably, the bucket mounting mechanism 10 removably mounts a bucket 12 having a capacity of between 1 and 5 gallons with respect to a vertically-disposed wall.

The bucket mounting mechanism 10 generally includes a bucket receiving portion 20 and a mounting portion 22. The bucket receiving portion 20 and the mounting portion 22 are preferably fabricated as a unitary structure from injected molded plastic.

The bucket receiving portion 20 is selected with an inner surface 24 that substantially conforms with the shape of an outer surface 26 of the bucket 12. A diameter of the inner surface 24 is slightly larger than a diameter of the outer surface 26 to allow the bucket 12 to be easily slid into the bucket receiving portion 20. However, the diameter of the inner surface 24 should not be considerably larger than the diameter of the outer surface 26 so that the bucket 12 is retained in a substantially fixed position within the bucket receiving portion 20.

Figure 2:
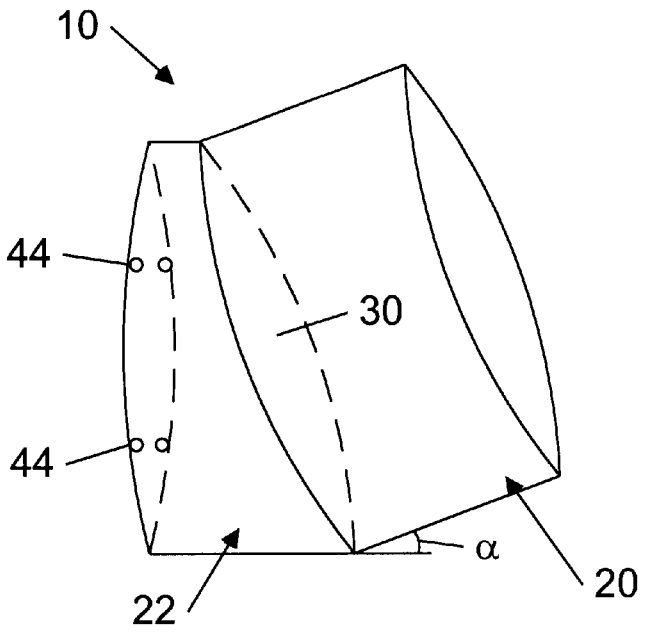
FIG. 2 is a side view of a bucket mounting mechanism according to the present invention.

A base portion 30 extends between the bucket receiving portion 20 and the mounting portion 22, as most clearly illustrated in FIG. 2. The base portion 30 limits the distance that the bucket is insertable into the bucket receiving portion 20. A person of ordinary skill in the art will appreciate that the base portion 30 does not need to extend completely across the bucket receiving portion 20 to limit the distance that the bucket is insertable into the bucket receiving portion 20. Alternatively, it is possible to form a lip that extends inwardly from the inner surface 24 to serve the same function as the base portion 30.

The mounting portion 22 extends from the bucket receiving portion 20 and allows the bucket receiving portion 20 to be mounted to the mounting surface 14. The mounting portion 22 also maintains the bucket receiving portion 20 at an angle $\alpha$ of between 0 and 90 degrees. The angle $\alpha$ is selected based on a desired amount and type of material that is to be stored in the bucket 12. The selection of the angle α also dictates the proximity to which the bucket holders 10 may be mounted adjacent to each other.

As the angle α is increased, it becomes possible to hold more objects in the bucket 12. However, increasing the angle α necessitates that the vertical spacing between bucket mounting mechanisms 10 be increased. Conversely, decreasing the angle α allows the vertical spacing between bucket mounting mechanisms 10 to be reduced while also reducing the number of objects that may be stored in the buckets 12. For most applications, the angle α is preferably between about 20 and 30 degrees.

The bucket mounting mechanism 10 also preferably includes a plurality of mounting brackets 44 that are formed in the base portion 22. The mounting brackets 44 are selected to receive a mounting mechanism such as a screw.

Figure 4:
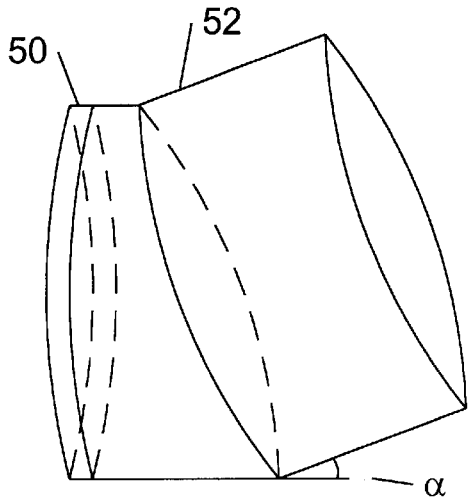
FIG. 4 is a side view of an alternative embodiment of the bucket mounting mechanism.

An alternative mounting mechanism for the present invention includes a mounting plate 50 that is removably attached to a main body 52 of the bucket mounting mechanism, as most clearly illustrated in FIG. 4. The mounting plate 50 preferably has a circular profile that substantially conforms with a profile of the main body 52.

Figure 5:
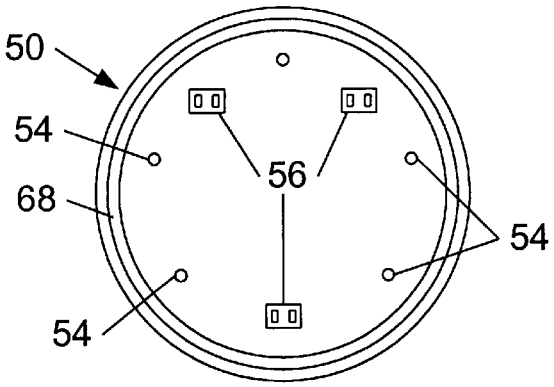
FIG. 5 is an elevational view of a main body of the bucket mounting mechanism.

In this embodiment, the mounting plate 50 is attached to a wall (not shown) using a suitable fastening mechanism (not shown) such as a screw. The mounting plate 50 includes a plurality of apertures 54 that are in a spaced-apart orientation, as most clearly illustrated in FIG. 5. The apertures 54 are adapted to receive the fastening mechanisms.

The main body 52 leg attached to the mounting plate 50 is a plurality of attachment mechanisms 56. The attachment mechanisms 56 maintain the main body 52 in a stationary position with respect to the mounting plate 50 while allowing the main body 52 to be separated from the mounting plate 50 when it is desired to change the location of the bucket mounting mechanism 10 on the wall (not shown).

Figure 7:
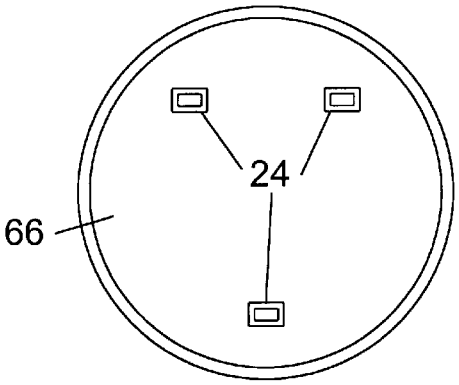
FIG. 7 is an elevational view of a back surface of the main body.

Each of the mounting mechanisms 56 preferably includes a pair of resilient arms 60 that extend from the mounting plate 50. The resilient arms 60 extend through apertures 64 in a back surface 66 of the main body 52. The apertures 64 are oriented on the back surface 66 in a manner that is similar to the orientation of the resilient arms 60, as most clearly illustrated in FIG. 7.

Figure 6:
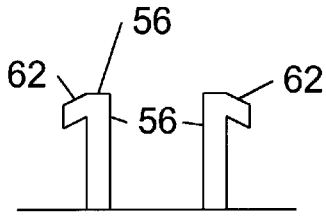
FIG. 6 is an elevational view of a mounting plate of the bucket mounting mechanism.

The resilient nature of the arms 60 allows the arms 60 to be bent towards each other for attaching the main body 52 to the mounting plate 50, as most clearly illustrated in FIG. 6. Each of the resilient arms 60 preferably includes a lip 62 extending therefrom. The lip 62 assists in retaining the mounting plate 50 in engagement with the main body 52.

To further assist in retaining the main body 52 in a fixed position with respect to the mounting plate 50, the mounting plate 50 preferably includes a ridge 68 extending therefrom. The ridge 68 engages an inner surface of the main body 52 when the main body is attached to the mounting plate 50.

The use of the bucket mounting mechanisms 10 to mount the buckets 12, as most clearly illustrated in FIG. 1. This configuration substantially reduces the amount of floor space that must be reserved for storing the buckets 12 reduced when compared to the prior art arrangements where the buckets were merely placed on the floor.

Figure 3:
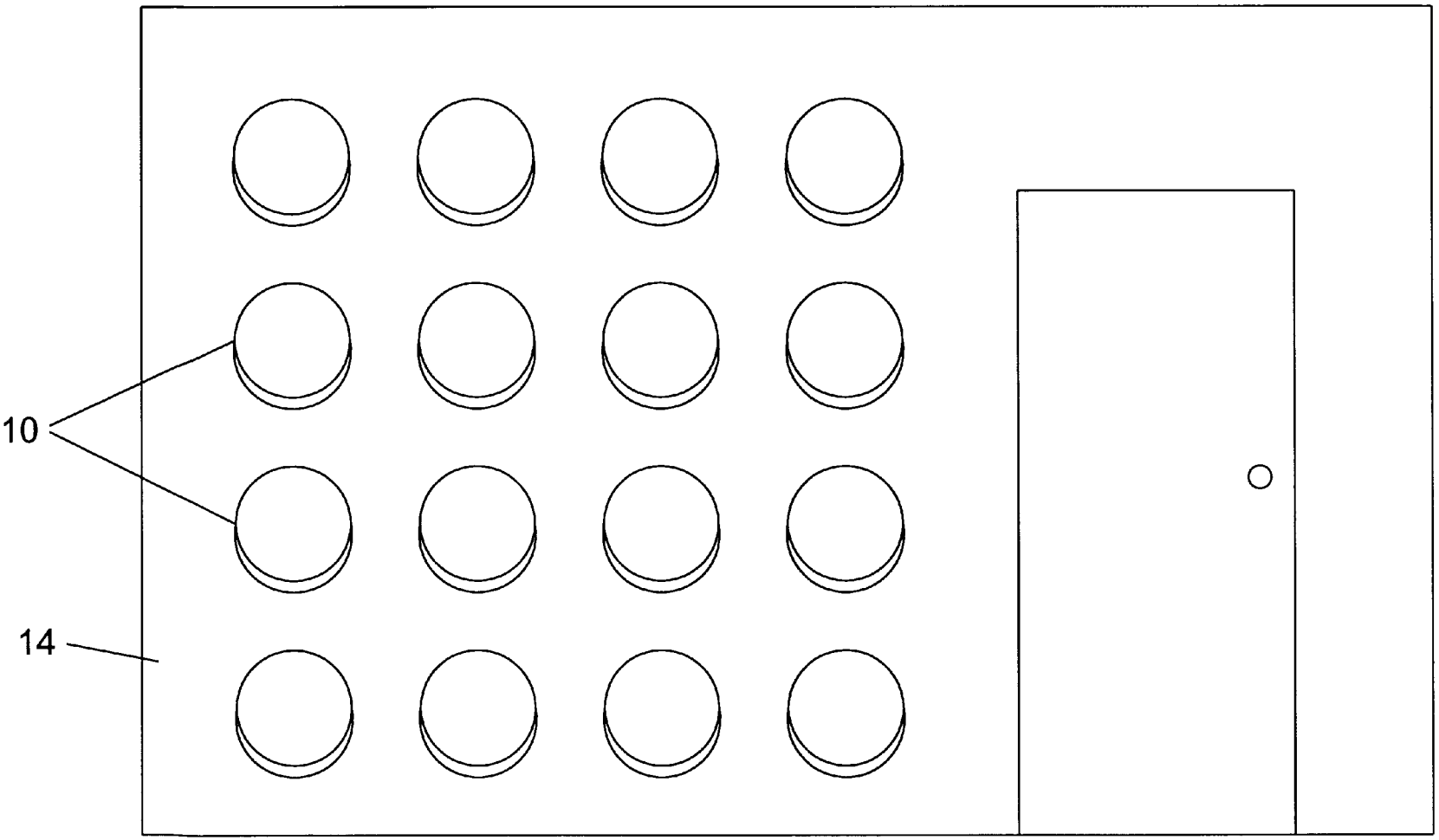
FIG. 3 is a front elevational view of a plurality of bucket mounting mechanisms oriented on a vertically-disposed wall.

The potential space savings when using the bucket mounting mechanism 10 of the present invention is further emphasized by viewing the array of bucket mounting mechanisms 10 illustrated in FIG. 3. While FIG. 3 illustrates that adjacent bucket mounting mechanisms 10 are placed directly to the side and above adjacent bucket mounting mechanisms 10, a person of ordinary skill in the art will also appreciate that the bucket mounting mechanisms 10 may be arranged so that the bucket mounting mechanisms 10 are off-set from each other. Such a configuration would further reduce the amount of space needed for storing a specified number of buckets 12.

Figure 8:
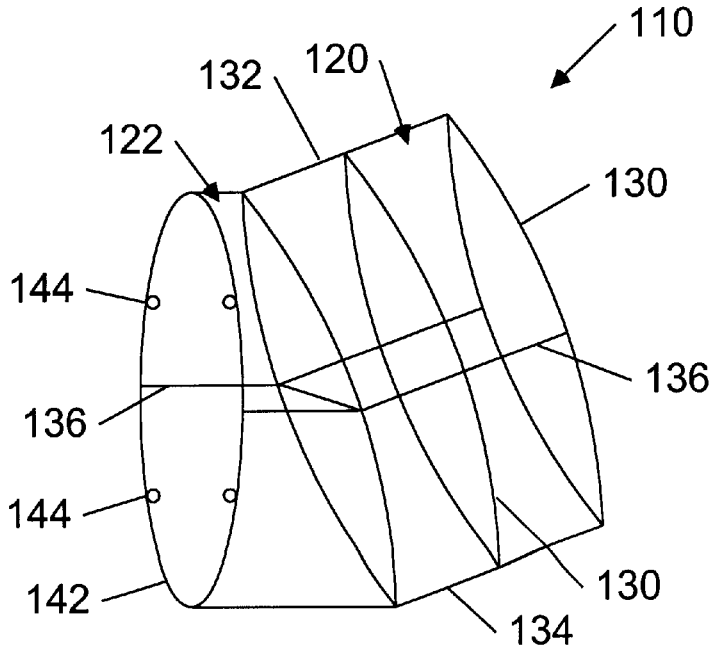
FIG. 8 is a side view of an alternative embodiment of the bucket mounting mechanism.

In an alternative embodiment, a bucket mounting mechanism 110 is formed from a arrangement of wires, as most clearly illustrated in FIG. 8. As used herein, the term "wire" means any material having a length that is relatively long when compared to the width and thickness of the material. The wire is preferably constructed from a metallic material that is welded together at the intersection points. However, a person of ordinary skill in the art will appreciate that the bucket mounting mechanism 110 may be fabricated from other materials without going beyond the scope of the present invention.

The bucket mounting mechanism 110 has a bucket receiving portion 120 and a mounting portion 122. The bucket receiving portion 120 is preferably fabricated from at least two substantially cylindrical rings 130. However, the number of cylindrical rings 130 that are needed to adequately support a bucket placed in the bucket receiving portion 120 depends on length, width, and capacity of the bucket. The mounting portion 122 preferably includes at least one substantially cylindrical ring 142.

The cylindrical rings 130, 142 are preferably attached together with a top wire member 132, a bottom wire member 134, and two side wire members 136. Similar to the number of cylindrical rings 130, the number and placement of wire members is selected based on the length, width, and capacity of the bucket.

The bucket receiving portion 120 also preferably has a base support wire member 140 that extends between the top wire member 132 and the bottom wire member 134 to limit a distance to which the bucket 12 is insertable into the bucket receiving portion 120.

The bucket mounting mechanism 110 also preferably includes a plurality of mounting brackets 144 that are attached to the cylindrical ring 142. The mounting brackets 144 are selected to receive a mounting mechanism such as a screw.

Although the present invention has been described with reference to preferred embodiments, workers skilled in the art will recognize that changes may be made in form and detail without departing from the spirit and scope of the invention.

What is claimed is:

1. A bucket mounting mechanism for mounting a bucket at a predetermined angle with respect to a surface, the bucket mounting mechanism comprising:

a bucket receiving portion having a substantially cylindrical shape;

a mounting portion retaining the bucket receiving portion at a predetermined angle with respect to a mounting surface wherein the mounting portion has a plurality of apertures formed therein, wherein the bucket receiving portion and the mounting portion are formed from wire, and wherein the bucket receiving portion and the mountining portion are formed from: at least two substantially cylindrical rings; a top wire member; a bottom wire member; and two side wire members, wherein the top wire member, the bottom wire member, and the side wire members are attached to and extend between the cylindrical rings so as to define a substantially cylindrical shape; and a mounting plate engaging the mounting portion for attaching the bucket mounting mechanism to a surface, wherein the mounting plate includes a plurality of attachment mechanisms, wherein each attachment mechanism engages the mounting portion proximate at least one of the plurality of apertures and thereby retains the mounting portion in a fixed relationship with respect to the mounting plate.

2. The bucket mounting mechanism of claim 1, wherein the predetermined angle between the mounting portion and the bucket receiving portion is between 20 and 30 degrees.

3. The bucket mounting mechanism of claim 1, and further comprising a base support wire member attached to and extending between the top wire member and the bottom wire member intermediate the top wire member and the bottom wire member.

4. The bucket mounting mechanism of claim 1, and further comprising a plurality of mounting brackets attached to the mounting portion.

5. A bucket mounting mechanism for mounting a bucket at a predetermined angle with respect to a vertically disposed mounting surface, the bucket mounting mechanism comprising:

a bucket receiving portion having a substantially cylindrical shape;

a mounting portion capable of retaining the bucket receiving portion at an angle with respect to the vertically-disposed wall mounting surface, wherein the mounting portion has a plurality of apertures formed therein; and a mounting plate engaging the mounting portion for attaching the bucket mounting mechanism to a surface, wherein the mounting plate includes a plurality of attachment mechanisms, wherein each attachment mechanism comprises a pair of resilient arms and an outwardly directed lip extending from each of the resilient arms opposite the mounting plate, and wherein each attachment mechanism engages the mounting portion proximate at least one of the plurality of apertures and thereby retains the mounting portion in a fixed relationship with respect to the mounting plate.

6. The bucket mounting mechanism of claim 5, wherein the predetermined angle between the mounting portion and the bucket receiving portion is between 20 and 30 degrees.

7. The bucket mounting mechanism of claim 5, and further comprising a plurality of mounting brackets attached to the mounting portion.

8. A method of mounting a bucket, having a capacity of between 1 gallon and 5 gallons, to a surface, the method comprising:

fabricating a bucket mounting mechanism having a bucket receiving portion, a mounting portion and a mounting plate, wherein the bucket receiving portion has a substantially cylindrical shape, wherein the mounting portion is oriented at a predetermined angle with respect to the bucket mounting mechanism, wherein the mounting portion has a plurality of apertures formed therein, and wherein the mounting plate includes a plurality of attachment mechanisms, wherein the bucket mounting mechanism is fabricated from wires, and wherein the bucket receiving portion and the mounting portion are formed from at least two substantially cylindrical rings, a top wire member, a bottom wire member, and two side wire members;

attaching the mounting plate to the surface;

attaching the mounting portion to the mounting plate, wherein each attachment mechanism engages the mounting portion proximate at least one of the plurality of apertures and thereby retains the mounting portion in a fixed relationship with respect to the mounting plate; and positioning a bucket having a capacity of between 1 gallon and 5 gallons at least partially within the bucket receiving portion to thereby removably mount the bucket at a predetermined angle with respect to the surface.

9. The method of claim 8, wherein the predetermined angle between the mounting portion and the bucket receiving portion is between 20 and 30 degrees.

10. The method of claim 8, wherein fabricating the bucket mounting mechanism further comprises attaching a plurality of mounting brackets to the mounting portion.

11. The method of claim 8, and further comprising attaching a base support wire to the top wire member and the bottom wire member intermediate the top wire member and the bottom wire member.

12. The method of claim 11, and further comprising attaching a plurality of mounting brackets to the mounting portion.

* * * * *